US012522959B2

(12) United States Patent
Booth et al.

(10) Patent No.: US 12,522,959 B2
(45) **Date of Patent: *Jan. 13, 2026**

(54) WOVEN SILT FENCE FABRICS

(71) Applicant: Willacoochee Industrial Fabrics, Inc., Nashville, GA (US)

(72) Inventors: Eric Lee Booth, Nashville, GA (US); Melissa Grace, Gulf Breeze, FL (US); Kevin William Ray, Enigma, GA (US)

(73) Assignee: Willacoochee Industrial Fabrics, Inc., Willacoochee, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/177,095

(22) Filed: Apr. 11, 2025

(65) Prior Publication Data

US 2025/0389062 A1 Dec. 25, 2025

Related U.S. Application Data

(60) Provisional application No. 63/750,130, filed on Jan. 27, 2025, provisional application No. 63/662,301, filed on Jun. 20, 2024.

(51) Int. Cl.

| | |
|---|---|
| ***D03D 15/46*** | (2021.01) |
| ***D03D 15/43*** | (2021.01) |
| ***D03D 15/54*** | (2021.01) |
| *E04H 17/02* | (2006.01) |

(52) U.S. Cl.

CPC ..... *D03D 15/46* (2021.01); *D03D 15/43* (2021.01); *D03D 15/54* (2021.01); *D10B 2401/063* (2013.01); *D10B 2505/20* (2013.01)

(58) Field of Classification Search

CPC ..... D03D 15/46; D03D 15/43; D03D 15/54; D10B 2401/063; D10B 2505/20

See application file for complete search history.

(56) References Cited

U.S. PATENT DOCUMENTS

| | | | | |
|---|---|---|---|---|
| RE42,695 | E | 9/2011 | Singleton | |
| 8,747,027 | B1 | 6/2014 | Singleton | |
| 9,404,233 | B2 | 8/2016 | Jones et al. | |
| 10,024,022 | B2 * | 7/2018 | Booth | D03D 13/008 |
| 10,145,080 | B2 | 12/2018 | Segroves et al. | |
| 10,434,445 | B2 * | 10/2019 | Ray | D03D 13/008 |
| 10,487,471 | B2 * | 11/2019 | Booth | D03D 13/008 |
| 10,508,400 | B2 * | 12/2019 | Booth | E02D 17/202 |
| 11,174,612 | B2 * | 11/2021 | Booth | D03D 15/567 |

(Continued)

OTHER PUBLICATIONS

U.S. Appl. No. 19/177,106, filed Apr. 11, 2025 entitled Woven Silt Fence Fabrics.

(Continued)

*Primary Examiner* — Robert H Muromoto, Jr.

(74) *Attorney, Agent, or Firm* — Harness, Dickey & Pierce, P.L.C.; Anthony G. Fussner

(57) ABSTRACT

A woven silt fence fabric includes two or more different warp yarns having different cross-sectional shapes in the machine direction and/or two or more different fill yarns having different cross-sectional shapes in the cross-machine/transverse direction. The woven silt fence fabric includes one or more marker yarns having a different color than adjacent yarn(s) to thereby identify one or more of a grade line, install line, monitor line, and/or high visibility line.

29 Claims, 9 Drawing Sheets

Woven Silt Fence Fabric Cross Section

(56) References Cited

U.S. PATENT DOCUMENTS

| | | | | |
|---|---|---|---|---|
| 11,384,458 | B2 * | 7/2022 | Ray | D03D 15/43 |
| 11,634,880 | B2 | 4/2023 | Segroves et al. | |
| 11,873,588 | B2 * | 1/2024 | Ray | D03D 15/46 |
| D1,058,321 | S | 1/2025 | Taylor | |
| 12,410,543 | B1 * | 9/2025 | Booth | E04H 17/00 |
| 2014/0241817 | A1 * | 8/2014 | Jones | E02D 3/005 442/203 |
| 2015/0159305 | A1 * | 6/2015 | Booth | E02D 17/202 442/189 |
| 2016/0362865 | A1 | 12/2016 | Segroves et al. | |
| 2017/0342675 | A1 * | 11/2017 | Booth | E02B 3/125 |
| 2017/0354907 | A1 * | 12/2017 | Ray | D03D 15/37 |
| 2018/0320332 | A1 * | 11/2018 | Booth | D03D 13/008 |
| 2020/0030728 | A1 * | 1/2020 | Ray | D03D 15/47 |
| 2023/0265633 | A1 | 8/2023 | Segroves et al. | |
| 2023/0304249 | A1 | 9/2023 | Ray et al. | |
| 2025/0075458 | A1 | 3/2025 | Ray et al. | |
| 2025/0075459 | A1 | 3/2025 | Ray et al. | |

OTHER PUBLICATIONS

U.S. Appl. No. 19/177,095, filed Apr. 11, 2025 entitled Woven Silt Fence Fabrics.
U.S. Appl. No. 18/825,595, filed Sep. 5, 2025 entitled Woven Silt Fence Fabrics Including Two Or More Distinctly Different Colors Of Warp Yarns In The Machine Direction.
WINFAB 105SF Product Data Sheet; <www.winfabusa.com;> 2021; 1 page.
Woven Geotextile W-100; <www.skaps.com;> accessed Jan. 28, 2025; 1 page.
VSF-Technical Data Sheet; VSF: Virginia DOT Silt Fence; <www.fergusongss.com;> 2022; 1 page.
TerraTex SF-D100 Data Sheet; <www.HanesGeo.com;> Jan. 2023; 1 page.
TerraTex SF-60 Product Data Sheet; <www.HanesGeo.com;> Jan. 2023; 1 page.
TerraTex GS; <www.HanesGeo.com;> Jan. 2023; 1 page.
SMARTfence® PL36; High-Tensile/High-Modulus Woven Geotextile Sediment Fence; Nov. 2023; 2 pages.
SMARTfence® 42 High-Tensile/High-Modulus Woven Geotextile Sediment Fence; Nov. 2023; 2 pages.
Propex 2130; Propex© Fabrics; <www.geotextile.com/sediment/sediment.htm;> Mar. 10, 2005; 3 pages.
LS125 Technical Data Sheet; ACF LS125: Super Grade; <www.fergusongss.com;> 2022; 1 page.
WINFAB 121ODT Product Data Sheet; <www.winfabusa.com;> 2016; 1 page.
WINFAB 77SF Product Data Sheet; www.winfabusa.com; 2016; 1 page.
WINFAB 2020HDX-USA Product Data Sheet; <www.winfabusa.com;> Oct. 2, 2023; 1 page.
WINFAB(r) 2098 Product Data Sheet; <www.winfabusa.com;> 2016; one page.
Fabric Property Chart; accessed Jan. 23, 2025; 1 page.
Geotextile Specification for Highway Applications; AASHTO Designation: M-288-00; 2000; 20 pages.
ECSTR3D; Erosion Control Plan Legend; Dec. 18, 2002; 1 page.
Beltech 1935 Georgia DOT Silt Fence Product Data Sheet; www.BeltonIndustries.com; Jun. 2014; 1 page.
WINFAB 2098R COC Contractor's Source; Mar. 18, 2014; 1 page.
El 14-003 New York State Department of Transportation Engineering Instruction; Standard Specification Section 737 Geosynthetics; Mar. 27, 2014; 28 pages.
Dubinsky, Gregg; Electronic Theses and Dissertations; Universty of Central Florida; Stars; Performance Evaluation of Two Silt Fence Geosynthetic Fabrics During and After Rainfall Event; http://library.ucf.edu; 2014; 158 pages.

* cited by examiner

| | | | |
|---|---|---|---|
| Warp Yarn: Oval Monofilament | 1200 denier | Count: | 27 |
| Fill Yarn: Round Monofilament | 1800 denier | Count: | 27 |
| **Property** | **Unit of Measure** | **Test Method** | **Test Value** |
| Tensile Strength (Grab) MD | lbs | ASTM D-4632 | 569 |
| Tensile Strength (Grab) CMD | lbs | ASTM D-4632 | 581 |
| Elongation (Grab) MD | % | ASTM D-4632 | 19.8 |
| Elongation (Grab) CMD | % | ASTM D-4632 | 14 |
| Trapezoidal Tear Strength MD | lbs | ASTM D-4533 | 307 |
| Trapezoidal Tear Strength CMD | lbs | ASTM D-4533 | 358 |
| CBR Puncture | lbs | ASTM D-6241 | 1701 |
| Wide Width Tensile @ Ultimate MD | lbs/ft | ASTM D-4595 | 4176 |
| Wide Width Tensile @ Ultimate CMD | lbs/ft | ASTM D-4595 | 5182 |
| Wide Width Tensile @ 2% Strain MD | lbs/ft | ASTM D-4595 | 769 |
| Wide Width Tensile @ 2% Strain CMD | lbs/ft | ASTM D-4595 | 1534 |
| Wide Width Tensile @ 5% Strain MD | lbs/ft | ASTM D-4595 | 1611 |
| Wide Width Tensile @ 5% Strain CMD | lbs/ft | ASTM D-4595 | 3485 |
| Apparent Opening Size | US Std. Sieve | ASTM D-4751 | 30 |
| Water Flow Rate | gpm | ASTM D-4491 | 105 |
| Permittivity | $sec^{-1}$ | ASTM D-4491 | 1.40 |

FIG. 6

| | | | |
|---|---|---|---|
| Warp Yarn: Oval Monofilament | 1200 denier | Count: | 27 |
| Fill Yarn: Round Monofilament | 700 denier | Count: | 40 |
| **Property** | **Unit of Measure** | **Test Method** | **Test Value** |
| Tensile Strength (Grab) MD | lbs | ASTM D-4632 | 535 |
| Tensile Strength (Grab) CMD | lbs | ASTM D-4632 | 400 |
| Elongation (Grab) MD | % | ASTM D-4632 | 19.3 |
| Elongation (Grab) CMD | % | ASTM D-4632 | 17.1 |
| Trapezoidal Tear Strength MD | lbs | ASTM D-4533 | 227 |
| Trapezoidal Tear Strength CMD | lbs | ASTM D-4533 | 230 |
| CBR Puncture | lbs | ASTM D-6241 | 1577 |
| Wide Width Tensile @ Ultimate MD | lbs/ft | ASTM D-4595 | 4356 |
| Wide Width Tensile @ Ultimate CMD | lbs/ft | ASTM D-4595 | 3540 |
| Wide Width Tensile @ 2% Strain MD | lbs/ft | ASTM D-4595 | 789 |
| Wide Width Tensile @ 2% Strain CMD | lbs/ft | ASTM D-4595 | 898 |
| Wide Width Tensile @ 5% Strain MD | lbs/ft | ASTM D-4595 | 1669 |
| Wide Width Tensile @ 5% Strain CMD | lbs/ft | ASTM D-4595 | 1764 |
| Apparent Opening Size | US Std. Sieve | ASTM D-4751 | 40 |
| Water Flow Rate | gpm | ASTM D-4491 | 65.3 |
| Permittivity | $sec^{-1}$ | ASTM D-4491 | 0.87 |

FIG. 7

| | | | |
|---|---|---|---|
| Warp Yarn: Oval Monofilament | 1600 denier | Count: | 27 |
| Fill Yarn: Round Monofilament | 1700 denier | Count: | 18 |
| Fill Yarn: Fibrillated | 2700 denier | Count: | 9 |
| **Property** | **Unit of Measure** | **Test Method** | **Test Value** |
| Tensile Strength (Grab) MD | lbs | ASTM D-4632 | 570 |
| Tensile Strength (Grab) CMD | lbs | ASTM D-4632 | 675 |
| Elongation (Grab) MD | % | ASTM D-4632 | 19 |
| Elongation (Grab) CMD | % | ASTM D-4632 | 16.6 |
| Trapezoidal Tear Strength MD | lbs | ASTM D-4533 | 249 |
| Trapezoidal Tear Strength CMD | lbs | ASTM D-4533 | 423 |
| CBR Puncture | lbs | ASTM D-6241 | 2034 |
| Wide Width Tensile @ Ultimate MD | lbs/ft | ASTM D-4595 | 5079 |
| Wide Width Tensile @ Ultimate CMD | lbs/ft | ASTM D-4595 | 5839 |
| Wide Width Tensile @ 2% Strain MD | lbs/ft | ASTM D-4595 | 860 |
| Wide Width Tensile @ 2% Strain CMD | lbs/ft | ASTM D-4595 | 1528 |
| Wide Width Tensile @ 5% Strain MD | lbs/ft | ASTM D-4595 | 1765 |
| Wide Width Tensile @ 5% Strain CMD | lbs/ft | ASTM D-4595 | 3067 |
| Apparent Opening Size | US Std. Sieve | ASTM D-4751 | 35 |
| Water Flow Rate | gpm | ASTM D-4491 | 88.2 |
| Permittivity | $sec^{-1}$ | ASTM D-4491 | 1.18 |

FIG. 8

| | | | |
|---|---|---|---|
| Warp Yarn: Oval Monofilament | 1600 denier | Count: | 27 |
| Fill Yarn: Round Monofilament | 1100 denier | Count: | 32 |
| **Property** | **Unit of Measure** | **Test Method** | **Test Value** |
| Tensile Strength (Grab) MD | lbs | ASTM D-4632 | 628 |
| Tensile Strength (Grab) CMD | lbs | ASTM D-4632 | 540 |
| Elongation (Grab) MD | % | ASTM D-4632 | 18 |
| Elongation (Grab) CMD | % | ASTM D-4632 | 21 |
| Trapezoidal Tear Strength MD | lbs | ASTM D-4533 | 228 |
| Trapezoidal Tear Strength CMD | lbs | ASTM D-4533 | 375 |
| CBR Puncture | lbs | ASTM D-6241 | 1879 |
| Wide Width Tensile @ Ultimate MD | lbs/ft | ASTM D-4595 | 5299 |
| Wide Width Tensile @ Ultimate CMD | lbs/ft | ASTM D-4595 | 4827 |
| Wide Width Tensile @ 2% Strain MD | lbs/ft | ASTM D-4595 | 1059 |
| Wide Width Tensile @ 2% Strain CMD | lbs/ft | ASTM D-4595 | 1259 |
| Wide Width Tensile @ 5% Strain MD | lbs/ft | ASTM D-4595 | 2166 |
| Wide Width Tensile @ 5% Strain CMD | lbs/ft | ASTM D-4595 | 2428 |
| Apparent Opening Size | US Std. Sieve | ASTM D-4751 | 30 |
| Water Flow Rate | gpm | ASTM D-4491 | 96.4 |
| Permittivity | $sec^{-1}$ | ASTM D-4491 | 1.29 |

FIG. 9

WOVEN SILT FENCE FABRICS

CROSS-REFERENCE TO RELATED APPLICATIONS

This application claims priority to and the benefit of U.S. Provisional Application No. 63/662,301 filed Jun. 20, 2024 and U.S. Provisional Application No. 63/750,130 filed Jan. 27, 2025. The entire disclosures of the above provisional applications are incorporated herein by reference.

FIELD

The present disclosure relates to woven silt fence fabrics.

BACKGROUND

This section provides background information related to the present disclosure which is not necessarily prior art.

Silt fences, also known as filter fences or sediment barriers, are commonly utilized in erosion control efforts. Silt fences are typically installed within a trench approximately 6 inches deep, supported by posts, as depicted in FIGS. 1 and 2.

Silt fence fabrics are strategically placed near construction zones or other areas where natural soil may be disturbed. During rainfall, disturbed soil can wash away, causing runoff that contaminates water bodies and exacerbates soil erosion. Silt fences act as temporary solutions to prevent such issues. Proper installation involves burying the fabric in a trench in the soil, typically 6 to 8 inches deep, while leaving a portion exposed above ground, usually 18 to 30 inches in height. The fabric is supported by posts or stakes (wood, metal, or synthetic) spaced at intervals along the fence. These posts are essential for maintaining the fence's upright position and stability against the forces of soil and water movement. Importantly, silt fences are designed to permit water flow while trapping sediment and soil, thereby reducing runoff and erosion.

DRAWINGS

The drawings described herein are for illustrative purposes only of selected embodiments and not all possible implementations and are not intended to limit the scope of the present disclosure.

FIGS. 6 through 9 include test data for woven silt fence fabric according to exemplary embodiments of the present disclosure.

DETAILED DESCRIPTION

Example embodiments will now be described more fully with reference to the accompanying drawings.

Disclosed herein are exemplary embodiments of woven silt fence fabrics including:

(A) two or more different warp yarns having different cross-sectional shapes and running (e.g., generally parallel with each other) in the machine direction; or (B) two or more different fill yarns having different cross-sectional shapes and running (e.g., generally parallel with each other) in the cross-machine/transverse direction; or (C) two or more different warp yarns having different cross-sectional shapes and running (e.g., generally parallel with each other) in the machine direction and two or more different fill yarns having different cross-sectional shapes and running (e.g., generally parallel with each other) in the cross-machine/transverse direction.

For example, an exemplary embodiment of a woven silt fence fabric includes two different fill yarn types having two different cross-sectional shapes and a single warp yarn type. The two different fill yarn types may be inserted generally parallel to each other in an alternating arrangement during the weaving process.

In another exemplary embodiment, a woven silt fence fabric includes two different warp yarn types having two different cross-sectional shapes and a single fill yarn type. In a further exemplary embodiment, woven silt fence fabric includes two different warp yarn types having two different cross-sectional shapes and two different fill yarn types having two different cross-sectional shapes.

Figure 1:
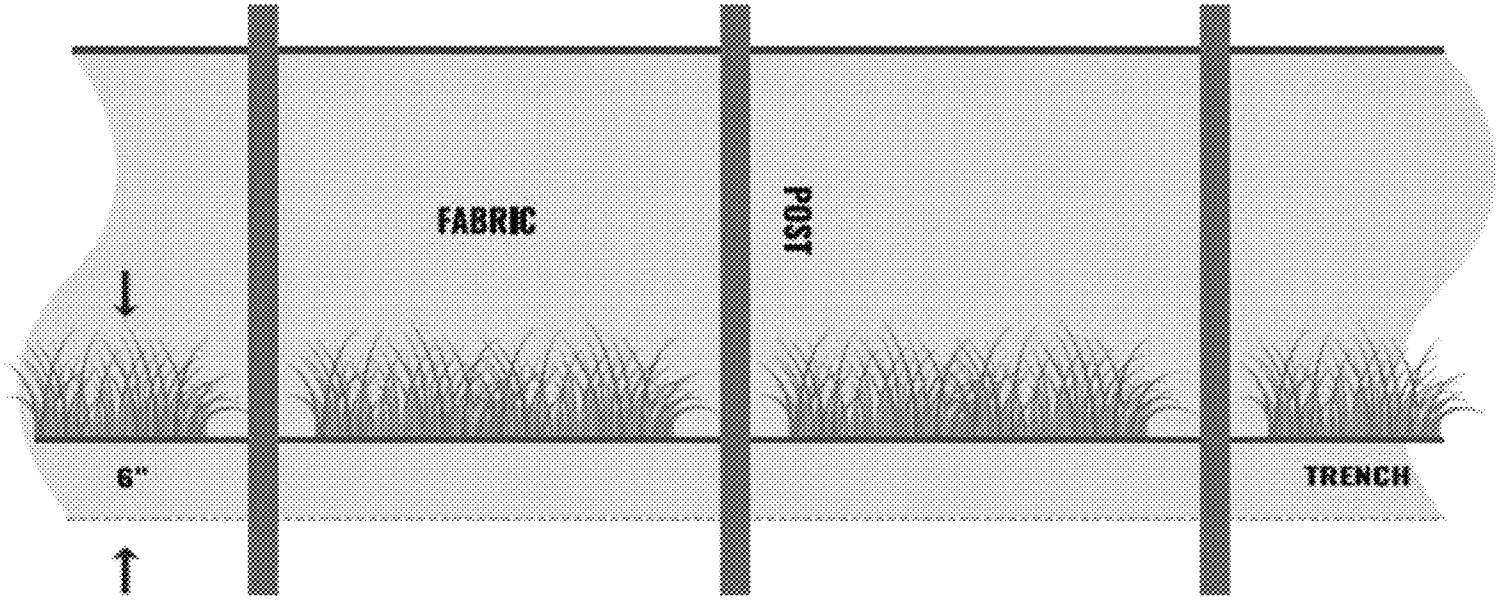
FIG. 1 (Prior Art)
FIGS. 1 and 2 are front and side views of an exemplary silt fence installed within a 6-inch deep trench and supported by posts.
Figure 2:
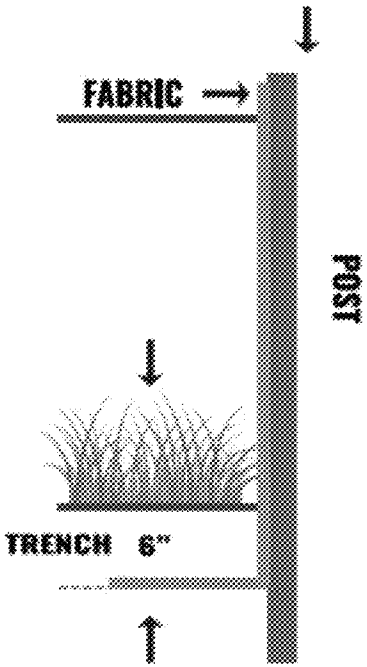
FIG. 2 (Prior Art)
Figure 3:
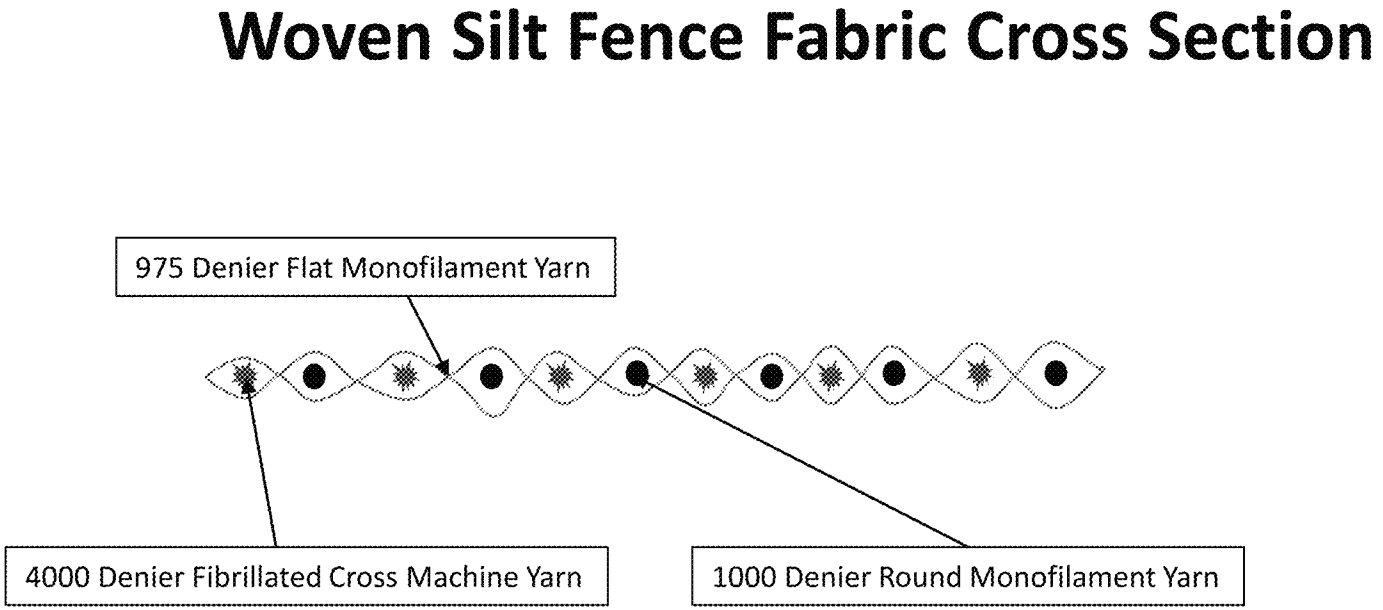
FIG. 3 illustrates a cross section of a woven silt fence fabric according to an exemplary embodiment of the present disclosure.

FIG. 3 illustrates a cross section of a woven silt fence fabric according to an exemplary embodiment of the present disclosure. In this example, the woven silt fence fabric includes monofilament yarn in the machine direction. The monofilament warp yarn has a 975 denier and a flat (e.g., rectangular, etc.) cross-sectional shape. Also in this example, the woven silt fence fabric includes monofilament yarn and fibrillated tape yarn in the transverse or cross machine direction. The monofilament and fibrillated tape fill yarns may be inserted generally parallel to each other in an alternating arrangement in the transverse or machine direction during the weaving process. The monofilament fill yarn in the transverse or machine direction has a 1000 denier and round cross-sectional shape. The fibrillated tape fill yarn in the transverse or machine direction has a 4000 denier and a general rectangular cross-sectional shape that will conform to the woven construction of the fabric into which the fibrillated tape fill yarn is inserted. The yarn types, cross-sectional shapes, and deniers shown in FIG. 3 are provided for purpose of illustration only as other exemplary embodiments may include different yarn types, cross-sectional shapes, and deniers in the machine direction and/or in the cross machine/transverse direction.

Figure 4:
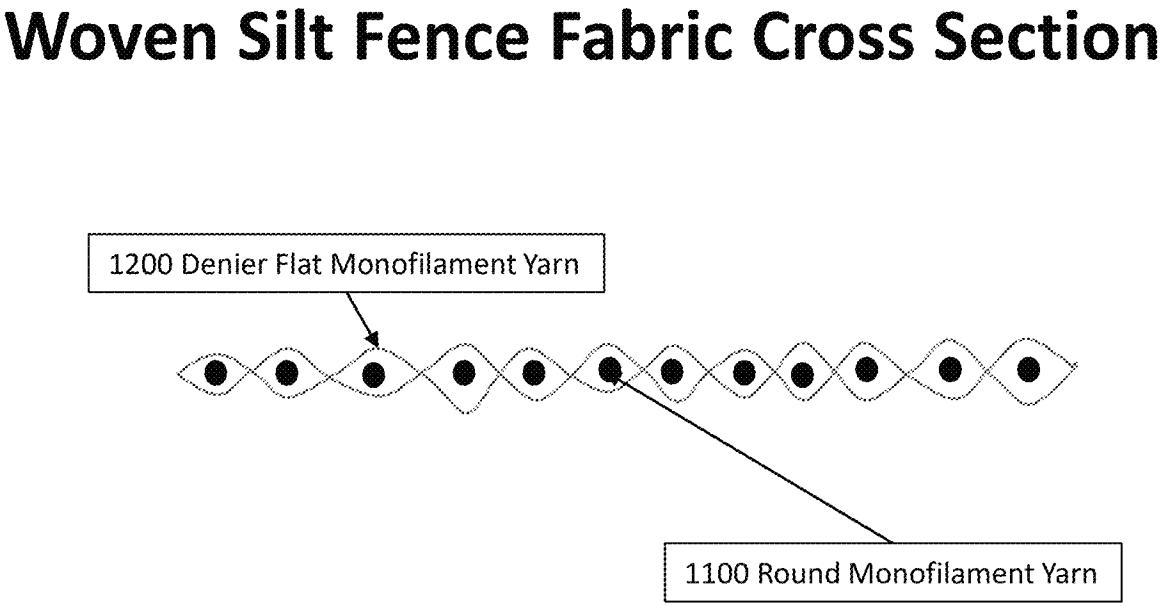
FIG. 4 illustrates a cross section of a woven silt fence fabric according to another exemplary embodiment of the present disclosure.

FIG. 4 illustrates a cross section of a woven silt fence fabric according to another exemplary embodiment of the present disclosure. In this example, the woven silt fence fabric includes monofilament yarn in the machine direction and monofilament yarn in the transverse or cross machine direction. The monofilament warp yarn in the machine direction has a 1200 denier and a flat (e.g., rectangular, etc.) cross-sectional shape. The monofilament fill yarn in the transverse or machine direction has a 1200 denier and round cross-sectional shape. The yarn types, cross-sectional shapes, and deniers shown in FIG. 4 are provided for purpose of illustration only as other exemplary embodiments may include different yarn types, cross-sectional shapes, and deniers in the machine direction and/or in the cross machine/transverse direction.

Figure 5:
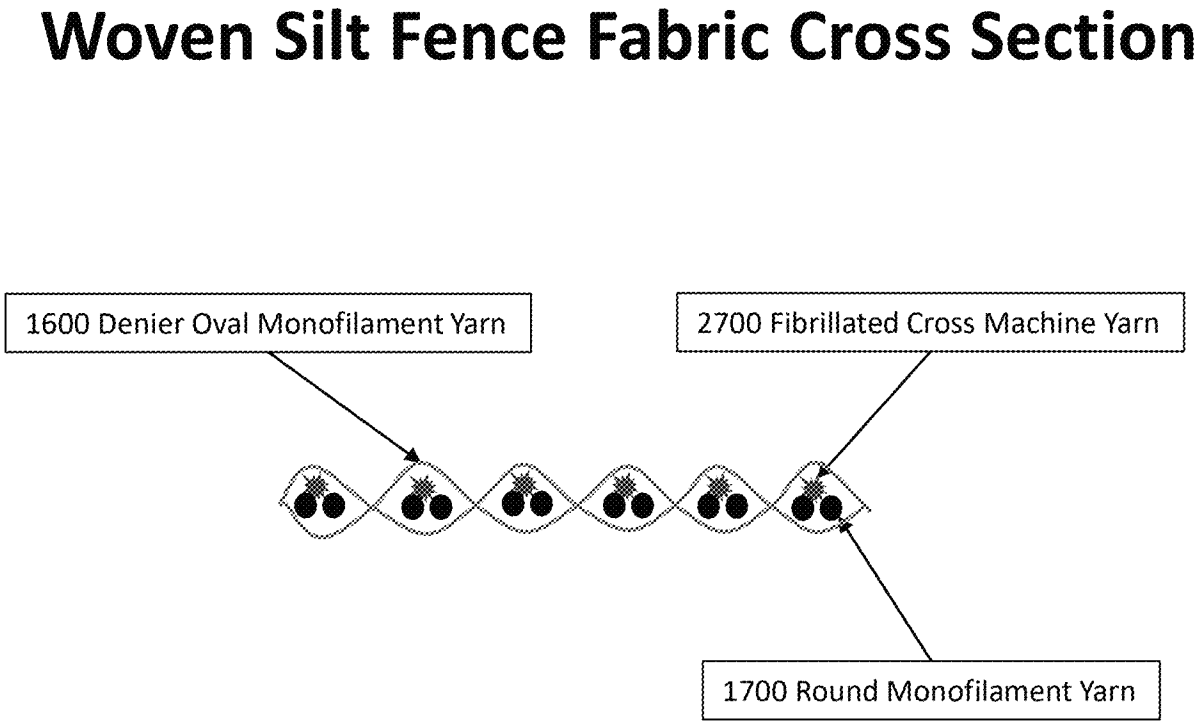
FIG. 5 illustrates a cross section of a woven silt fence fabric according to a further exemplary embodiment of the present disclosure.

FIG. 5 illustrates a cross section of a woven silt fence fabric according to a further exemplary embodiment of the present disclosure. In this example, the woven silt fence fabric includes monofilament yarn in the machine direction. The monofilament warp yarn in the machine direction has a 1600 denier and an oval cross-sectional shape. Also in this example, the woven silt fence fabric includes monofilament yarn and fibrillated tape yarn in the transverse or cross machine direction. The monofilament and fibrillated tape fill yarns may be inserted generally parallel to each other in an alternating arrangement in the transverse or machine direction during the weaving process. The monofilament fill yarn in the transverse or machine direction has a 1700 denier and round cross-sectional shape. The fibrillated tape fill yarn in the transverse or machine direction has a 2700 denier and a general rectangular cross-sectional shape that will conform to the woven construction of the fabric into which the fibrillated tape fill yarn is inserted. The yarn types, cross-sectional shapes, and deniers shown in FIG. 5 are provided for purpose of illustration only as other exemplary embodiments may include different yarn types, cross-sectional shapes, and deniers in the machine direction and/or in the cross machine/transverse direction.

FIG. 6 includes test data for a woven silt fence fabric according to an exemplary embodiment of the present disclosure. In this example, the woven silt fence fabric includes monofilament warp yarn having a 1200 denier, an oval cross-sectional shape, and count of 27. Also in this example, the woven silt fence fabric includes monofilament fill yarn having a 1800 denier, a round oval cross-sectional shape, and count of 27. As shown in FIG. 6, this example woven silt fence fabric had a wide width tensile strength (per ASTM D-4595) of 769 lbs/ft at 2% strain in the machine direction (MD), a wide width tensile strength (per ASTM D-4595) of 1534 lbs/ft at 2% strain in the cross-machine direction (CMD), a wide width tensile strength (per ASTM D-4595) of 1611 lbs/ft at 5% strain in the machine direction (MD), and a wide width tensile strength (per ASTM D-4595) of 3485 lbs/ft at 5% strain in the cross-machine direction (CMD). This example woven silt fence fabric also had an apparent opening size (per ASTM D-4751) of 30 U.S standard sieve, a water flow rate (per ASTM D-4491) of 105 gallons per minute (gpm), and a permittivity (per ASTM D-4491) of 1.40 $sec^{-1}$.

FIG. 7 includes test data for a woven silt fence fabric according to an exemplary embodiment of the present disclosure. In this example, the woven silt fence fabric includes monofilament warp yarn having a 1200 denier, an oval cross-sectional shape, and count of 27. Also in this example, the woven silt fence fabric includes monofilament fill yarn having a 700 denier, a round oval cross-sectional shape, and count of 40. As shown in FIG. 7, this example woven silt fence fabric had a wide width tensile strength (per ASTM D-4595) of 789 lbs/ft at 2% strain in the machine direction (MD), a wide width tensile strength (per ASTM D-4595) of 898 lbs/ft at 2% strain in the cross-machine direction (CMD), a wide width tensile strength (per ASTM D-4595) of 1669lbs/ft at 5% strain in the machine direction (MD), and a wide width tensile strength (per ASTM D-4595) of 1764 lbs/ft at 5% strain in the cross-machine direction (CMD). This example woven silt fence fabric also had an apparent opening size (per ASTM D-4751) of 40 U.S standard sieve, a water flow rate (per ASTM D-4491) of 65.3 gallons per minute (gpm), and a permittivity (per ASTM D-4491) of 0.87 $sec^{-1}$.

FIG. 8 includes test data for a woven silt fence fabric according to an exemplary embodiment of the present disclosure. In this example, the woven silt fence fabric includes monofilament warp yarn having a 1600 denier, an oval cross-sectional shape, and count of 27. Also in this example, the woven silt fence fabric includes monofilament fill yarn having a 1700 denier, a round oval cross-sectional shape, and count of 18 and fibrillated fill yarn having a 2700 denier and count of 9. As shown in FIG. 8, this example woven silt fence fabric had a wide width tensile strength (per ASTM D-4595) of 860 lbs/ft at 2% strain in the machine direction (MD), a wide width tensile strength (per ASTM D-4595) of 1528 lbs/ft at 2% strain in the cross-machine direction (CMD), a wide width tensile strength (per ASTM D-4595) of 1765 lbs/ft at 5% strain in the machine direction (MD), and a wide width tensile strength (per ASTM D-4595) of 3067 lbs/ft at 5% strain in the cross-machine direction (CMD). This example woven silt fence fabric also had an apparent opening size (per ASTM D-4751) of 35 U.S standard sieve, a water flow rate (per ASTM D-4491) of 88.2 gallons per minute (gpm), and a permittivity (per ASTM D-4491) of 1.18 $sec^{-1}$.

FIG. 9 includes test data for a woven silt fence fabric according to an exemplary embodiment of the present disclosure. In this example, the woven silt fence fabric includes monofilament warp yarn having a 1600 denier, an oval cross-sectional shape, and count of 27. Also in this example, the woven silt fence fabric includes monofilament fill yarn having a 1100 denier, a round oval cross-sectional shape, and count of 32. As shown in FIG. 9, this example woven silt fence fabric had a wide width tensile strength (per ASTM D-4595) of 1059 lbs/ft at 2% strain in the machine direction (MD), a wide width tensile strength (per ASTM D-4595) of 1259 lbs/ft at 2% strain in the cross-machine direction (CMD), a wide width tensile strength (per ASTM D-4595) of 2166 lbs/ft at 5% strain in the machine direction (MD), and a wide width tensile strength (per ASTM D-4595) of 2428 lbs/ft at 5% strain in the cross-machine direction (CMD). This example woven silt fence fabric also had an apparent opening size (per ASTM D-4751) of 30 U.S standard sieve, a water flow rate (per ASTM D-4491) of 96.4 gallons per minute (gpm), and a permittivity (per ASTM D-4491) of 1.29 $sec^{-1}$.

In another exemplary embodiment, a woven silt fence fabric includes tape yarn in the machine direction. The tape warp yarn has an 800 denier and a flat (e.g., rectangular, etc.) cross-sectional shape. Also in this example, the woven silt fence fabric includes monofilament yarn and fibrillated tape yarn in the transverse or cross machine direction. The monofilament and fibrillated tape fill yarns may be inserted generally parallel to each other in an alternating arrangement during the weaving process. The monofilament fill yarn has a 1000 denier and round cross-sectional shape. The fibrillated tape fill yarn has a 4000 denier and a general rectangular cross-sectional shape that will conform to the woven construction of the fabric into which the fibrillated tape fill yarn is inserted In a further exemplary embodiment, the woven silt fence fabric includes monofilament yarn and tape yarn in the machine direction. The monofilament and tape warp yarns may be inserted generally parallel to each other in an alternating arrangement during the weaving process. The monofilament warp yarn has a 975 denier and a flat (e.g., rectangular, etc.) cross-sectional shape. The tape warp yarn has an 800 denier and a flat (e.g., rectangular, etc.) cross-sectional shape. Also in this example, the woven silt fence fabric includes fibrillated tape yarn in the transverse or cross machine direction. The fibrillated tape fill yarn has a 4000 denier and a general rectangular cross-sectional shape that will conform to the woven construction of the fabric into which the fibrillated tape fill yarn is inserted.

In an additional exemplary embodiment, the woven silt fence fabric includes monofilament yarn and tape yarn in the machine direction. The monofilament and tape warp yarns may be inserted generally parallel to each other in an alternating arrangement during the weaving process. The monofilament warp yarn has a 1200 denier and a flat (e.g., rectangular, etc.) cross-sectional shape. The tape yarn has an 800 denier and a flat (e.g., rectangular, etc.) cross-sectional shape. Also in this example, the woven silt fence fabric includes fibrillated tape yarn in the transverse or cross machine direction. The fibrillated tape fill yarn has a 5000 denier and a general rectangular cross-sectional shape that will conform to the woven construction of the fabric into which the fibrillated tape fill yarn is inserted.

In another exemplary embodiment, the woven silt fence fabric includes monofilament yarn and tape yarn in the machine direction. The monofilament and tape warp yarns may be inserted generally parallel to each other in an alternating arrangement during the weaving process. The monofilament warp yarn has a 1600 denier and a flat (e.g., rectangular, etc.) cross-sectional shape. The tape warp yarn has a 1900 denier and a flat (e.g., rectangular, etc.) cross-sectional shape. Also in this example, the woven silt fence fabric includes fibrillated tape yarn and monofilament yarn in the transverse or cross machine direction. The fibrillated and monofilament fill yarns may be inserted generally parallel to each other in an alternating arrangement during the weaving process. The fibrillated tape fill yarn has a 5000 denier and a general rectangular cross-sectional shape that will conform to the woven construction of the fabric into which the fibrillated tape fill yarn is inserted. The monofilament fill yarn has a 1700 denier and round cross-sectional shape.

In exemplary embodiments, the warp yarns and/or fill yarns may comprise fibrillated tape yarn. A fibrillated tape yarn typically features a rectangular cross-section designed to conform to the woven construction of the fabric it is incorporated into. This type of yarn undergoes a modification process during manufacturing, where "cuts or slits" are added, making it more adaptable to the fabric's construction. In loosely woven fabrics, the fibrillated tape yarn can lie relatively flat, while in tightly woven fabrics, the fibrillated tape yarn tends to assume a round cross-sectional shape. Exemplary embodiments disclosed herein may utilize fibrillated warp yarns because the fibrillated tape yarns enable the incorporation of large yarns into very small spaces by cramming, packing, inserting, or weaving them in.

In exemplary embodiments, the weave pattern used for the woven silt fence fabric may comprise a plain or 1×1 weave, any twill weave (e.g., 2×1, 2×2, 3×1, 3×3, 4×4,etc.), herringbones, satin, baskets, leno, etc.

In exemplary embodiments, the warp yarns and/or fill yarns of the woven silt fence fabric may comprise flat/oval monofilament with denier ranges from 500 to 1800 denier, round monofilament with denier ranges from 500 to 2000 denier, and/or fibrillated tape yarns with denier ranges from 1000 to 15,000 denier.

In exemplary embodiments, the woven silt fence fabric is configured to have a tensile strength at 2% and 5% strain per ASTM D-4595 and ultimate strength per ASTM D-4595 exceeding that of a conventional geotextile including slit tape warp and fill yarns and/or a conventional geotextile including a combination of monofilament warp yarn and fibrillated slit tape fill yarns.

In exemplary embodiments, the woven silt fence fabric is configured to have: a wide width tensile strength (per ASTM D-4595) greater than 700 pounds/foot (lbs/ft) at 2% strain in the machine direction (MD) and cross-machine direction (CMD); and a wide width tensile strength (per ASTM D-4595) greater than 1400 lbs/ft at 5% strain in the machine direction (MD) and cross-machine direction (CMD). In such exemplary embodiments, the woven silt fence fabric may be configured to have: a wide width tensile strength (per ASTM D-4595) of at least about 1000 pounds/foot (lbs/ft) at 2% strain in the machine direction (MD) and cross-machine direction (CMD); and a wide width tensile strength (per ASTM D-4595) of at least about 2000 lbs/ft at 5% strain in the machine direction (MD) and cross-machine direction (CMD).

In exemplary embodiments, the woven silt fence fabric comprises monofilament warp yarn and monofilament fill yarn such that the woven silt fence fabric is woven entirely from (consists of only) the monofilament warp and fill yarns. In such exemplary embodiments, (A) the monofilament warp yarn may comprise two or more different monofilament warp yarns having different cross-sectional shapes; or (B) the monofilament fill yarn may comprise two or more different monofilament fill yarns having different cross-sectional shapes; or (C) the monofilament warp yarn may comprise two or more different monofilament warp yarns having different cross-sectional shapes, and the monofilament fill yarn may comprise two or more different monofilament fill yarns having different cross-sectional shapes.

In exemplary embodiments, the woven silt fence fabric includes a lower grade line and an upper edge defining an installed height between the lower grade line and the upper edge.

In exemplary embodiments, the woven silt fence fabric includes one or more marker yarns having a different color than adjacent yarn(s) to thereby identify one or more of a grade line, install line, monitor line, and/or high visibility line. In such exemplary embodiments, the one or more marker yarns comprise multiple groups of marker yarns having different color(s) than adjacent yarn(s) such the woven silt fence fabric includes two or more a grade line, an install line, a monitor line, and/or a high visibility line. And each group of marker yarns may have a same width as the other groups of marker yarns, or at least one group of marker yarns may have a different width than at least one other group of marker yarns. Additionally, or alternatively, the one or more of the grade line, install line, monitor line, and/or high visibility line identified by the one or more marker yarns may comprise a singular end(s) of the one or more marker yarns, or a wider group of multiple ends of the one or more marker yarns.

In exemplary embodiments, a silt fence system comprises a woven silt fence fabric as disclosed herein. One or more support posts are configured for attachment to the woven silt fence fabric for supporting the woven silt fence fabric.

Also disclosed are exemplary methods that comprise weaving yarns together to thereby provide a woven silt fence fabric as disclosed herein that has:

(A) two or more different warp yarns having different cross-sectional shapes; or (B) two or more different fill yarns having different cross-sectional shapes; or (C) two or more different warp yarns having different cross-sectional shapes and two or more different fill yarns having different cross-sectional shapes.

In exemplary embodiments, the weaving process includes inserting two or more different warp yarns having different cross-sectional shapes parallel with each other in the machine direction.

In exemplary embodiments, the weaving process includes inserting two or more different fill yarns having different cross-sectional shapes parallel with each other in the cross machine/transverse direction.

In exemplary embodiments, the weaving process includes inserting two or more different warp yarns having different cross-sectional shapes parallel with each other in the machine direction. The weaving process also includes inserting two or more different fill yarns having different cross-sectional shapes parallel with each other in the cross machine/transverse direction.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3,3-10, and 3-9.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected, or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A woven silt fence fabric comprising:

(A) two or more different warp yarns having different cross-sectional shapes; or (B) two or more different fill yarns having different cross-sectional shapes; or (C) two or more different warp yarns having different cross-sectional shapes and two or more different fill yarns having different cross-sectional shapes;

wherein the woven silt fence fabric includes one or more marker yarns having a different color than adjacent yarn(s) to thereby identify one or more of a grade line, install line, monitor line, and/or high visibility line.

2. The woven silt fence fabric of claim 1, wherein the woven silt fence fabric comprises the two or more different warp yarns having different cross-sectional shapes, the two or more different warp yarns extend or run in a machine direction substantially parallel with each other and with a length of the woven silt fence fabric.

3. The woven silt fence fabric of claim 2, wherein the two or more different warp yarns having different cross-sectional shapes also have different deniers.

4. The woven silt fence fabric of claim 1, wherein the woven silt fence fabric comprises the two or more different fill yarns having different cross-sectional shapes, the two or more different fill yarns extend or run in a cross machine/transverse direction substantially parallel with each other and with an installed height.

5. The woven silt fence fabric of claim 4, wherein the two or more different fill yarns having different cross-sectional shapes also have different deniers.

6. The woven silt fence fabric of claim 1, wherein the woven silt fence fabric comprises:

the two or more different warp yarns having different cross-sectional shapes, the two or more different warp yarns extend or run in a machine direction substantially parallel with each other and with a length of the woven silt fence fabric; and the two or more different fill yarns having different cross-sectional shapes, the two or more different fill yarns extend or run in a cross machine/transverse direction substantially parallel with each other and with an installed height.

7. The woven silt fence fabric of claim 6, wherein:

the two or more different warp yarns having different cross-sectional shapes also have different deniers; and the two or more different fill yarns having different cross-sectional shapes also have different deniers.

8. The woven silt fence fabric of claim 1, wherein:

the woven silt fence fabric comprises a single warp yarn type and two different fill yarn types;

the two different fill yarn types have two different cross-sectional shapes and two different deniers; and the two different fill yarn types extend or run in a cross machine/transverse direction substantially parallel with each other and with an installed height.

9. The woven silt fence fabric of claim 1, wherein:

the woven silt fence fabric comprises a single fill yarn type and two different warp yarn types;

the two different warp yarn types have two different cross-sectional shapes and two different deniers; and the two different warp yarn types extend or run in a machine direction substantially parallel with each other and with a length of the woven silt fence fabric.

10. The woven silt fence fabric of claim 1, wherein the woven silt fence fabric comprises:

two different warp yarn types having two different cross-sectional shapes and two different deniers, the two different warp yarn types extend or run in a machine direction substantially parallel with each other and with a length of the woven silt fence fabric; and two different fill yarn types having two different cross-sectional shapes and two different deniers, the two different fill yarn types extend or run in a cross machine/transverse direction substantially parallel with each other and with an installed height.

11. The woven silt fence fabric of claim 1, wherein the woven silt fence fabric comprises:

monofilament warp yarn having about 975 denier and a flat cross-sectional shape, the monofilament warp yarn extends or runs in a machine direction substantially parallel with a length of the woven silt fence fabric;

fibrillated tape fill yarn having about 4000 denier and a general rectangular cross-sectional shape that will conform to the woven structure of the woven silt fence fabric into which the fibrillated fill yarn is inserted; and monofilament fill yarn having about 1000 denier and round cross-sectional shape;

wherein the monofilament fill yarn and the fibrillated tape fill yarn extend or run in a cross machine/transverse direction substantially parallel with each other and with an installed height.

12. The woven silt fence fabric of claim 1, wherein the woven silt fence fabric comprises:

monofilament warp yarn having about 1600 denier and an oval cross-sectional shape, the monofilament warp yarn extends or runs in a machine direction substantially parallel with a length of the woven silt fence fabric;

fibrillated tape fill yarn having about 2700 denier and a general rectangular cross-sectional shape that will conform to the woven structure of the woven silt fence fabric into which the fibrillated fill yarn is inserted; and monofilament fill yarn having about 1700 denier and round cross-sectional shape;

wherein the monofilament fill yarn and the fibrillated tape fill yarn extend or run in a cross machine/transverse direction substantially parallel with each other and with an installed height.

13. The woven silt fence fabric of claim 12, wherein the woven silt fence fabric is configured to have:

a wide width tensile strength (per ASTM D-4595) of at least about 860 lbs/ft at 2% strain in the machine direction (MD);

a wide width tensile strength (per ASTM D-4595) of at least about 1528 lbs/ft at 2% strain in the cross-machine direction (CMD);

a wide width tensile strength (per ASTM D-4595) of at least about 1765 lbs/ft at 5% strain in the machine direction (MD); and a wide width tensile strength (per ASTM D-4595) of at least about 3067 lbs/ft at 5% strain in the cross-machine direction (CMD).

14. The woven silt fence fabric of claim 1, wherein the woven silt fence fabric comprises:

tape warp yarn having about 800 denier and a flat cross-sectional shape, the tape warp yarn extends or runs in a machine direction substantially parallel with a length of the woven silt fence fabric;

fibrillated tape fill yarn having about 4000 denier and a general rectangular cross-sectional shape that will conform to the woven structure of the woven silt fence fabric into which the fibrillated fill yarn is inserted; and monofilament fill yarn having about 1000 denier and round cross-sectional shape;

wherein the monofilament fill yarn and the fibrillated tape fill yarn extend or run in a cross machine/transverse direction substantially parallel with each other and with an installed height.

15. The woven silt fence fabric of claim 1, wherein the woven silt fence fabric comprises:

fibrillated tape fill yarn having about 4000 denier and a general rectangular cross-sectional shape that will conform to the woven structure of the woven silt fence fabric into which the fibrillated fill yarn is inserted, the fibrillated tape fill yarn extends or runs in a cross machine/transverse direction substantially parallel with an installed height;

monofilament warp yarn having about 975 denier and a flat cross-sectional shape; and tape warp yarn having about 800 denier and a flat cross-sectional shape;

wherein the monofilament warp yarn and the tape warp yarn extend or run in a machine direction substantially parallel with each other and with a length of the woven silt fence fabric.

16. The woven silt fence fabric of claim 1, wherein the woven silt fence fabric comprises:

fibrillated tape fill yarn having about 5000 denier and a general rectangular cross-sectional shape that will conform to the woven structure of the woven silt fence fabric into which the fibrillated fill yarn is inserted, the fibrillated tape fill yarn extends or runs in a cross machine/transverse direction substantially parallel with an installed height;

monofilament warp yarn having about 1200 denier and a flat cross-sectional shape; and tape warp yarn having about 800 denier and a flat cross-sectional shape;

wherein the monofilament warp yarn and the tape warp yarn extend or run in a machine direction substantially parallel with each other and with a length of the woven silt fence fabric.

17. The woven silt fence fabric of claim 1, wherein the woven silt fence fabric comprises:

monofilament warp yarn having about 1600 denier and a flat cross-sectional shape, tape warp yarn having about 1900 denier and a flat cross-sectional shape, the monofilament warp yarn and the tape warp yarn extend or run in a machine direction substantially parallel with each other and with a length of the woven silt fence fabric; and fibrillated tape fill yarn having about 5000 denier and a general rectangular cross-sectional shape that will conform to the woven structure of the woven silt fence fabric into which the fibrillated fill yarn is inserted, the monofilament fill yarn having about 1700 denier and round cross-sectional shape, the monofilament fill yarn and the fibrillated tape fill yarn extend or run in a cross machine/transverse direction substantially parallel with each other and with an installed height.

18. The woven silt fence fabric of claim 1, wherein the woven silt fence fabric is configured to be anisotropic.

19. The woven silt fence fabric of claim 1, wherein the woven silt fence fabric is configured to be isotropic.

20. The woven silt fence fabric of claim 1, wherein the different cross-sectional shapes include one or more of: round, flat, multilobal, oval, trilobal, triangular, rectangular, non-circular, and/or non-rectangular.

21. The woven silt fence fabric of claim 1, wherein:

the woven silt fence fabric includes one or more monofilament warp yarns, tape warp yarns, and/or fibrillated warp yarn; and/or the woven silt fence fabric includes one or more monofilament fill yarns, tape fill yarns, and/or fibrillated tape fill yarn.

22. The woven silt fence fabric of claim 1, wherein:

the woven silt fence fabric includes one or more of: a monofilament warp yarn having a flat cross-sectional shape and/or a tape warp yarn having a flat cross-sectional shape; and/or the woven silt fence fabric includes one or more of: a monofilament fill yarn having a round cross-sectional shape and/or a fibrillated warp yarn having a general rectangular cross-sectional shape that will conform to the woven structure of the woven silt fence fabric into which the fibrillated fill yarn is inserted.

23. The woven silt fence fabric of claim 1, wherein the warp yarns and/or the fill yarns comprise one or more of:

flat/oval monofilament with denier ranges from 500 to 1800 denier;

round monofilament with denier ranges from 500 to 2000 denier; and/or fibrillated tape yarn with denier ranges from 1000 to 15,000 denier.

24. The woven silt fence fabric of claim 1, wherein the woven silt fence fabric is configured to have:

a wide width tensile strength (per ASTM D-4595) greater than 700 pounds/foot (lbs/ft) at 2% strain in the machine direction (MD) and cross-machine direction (CMD); and a wide width tensile strength (per ASTM D-4595) greater than 1400 lbs/ft at 5% strain in the machine direction (MD) and cross-machine direction (CMD).

25. The woven silt fence fabric of claim 1, wherein the woven silt fence fabric is configured to have:

a wide width tensile strength (per ASTM D-4595) of at least about 1000 pounds/foot (lbs/ft) at 2% strain in the machine direction (MD) and cross-machine direction (CMD); and a wide width tensile strength (per ASTM D-4595) of at least about 2000 lbs/ft at 5% strain in the machine direction (MD) and cross-machine direction (CMD).

26. The woven silt fence fabric of claim 1, wherein the woven silt fence fabric comprises monofilament warp yarn and monofilament fill yarn such that the woven silt fence fabric is woven entirely from the monofilament warp and fill yarns, and wherein:

(A) the monofilament warp yarn comprises two or more different monofilament warp yarns having different cross-sectional shapes; or (B) the monofilament fill yarn comprises two or more different monofilament fill yarns having different cross-sectional shapes; or (C) the monofilament warp yarn comprises two or more different monofilament warp yarns having different cross-sectional shapes, and the monofilament fill yarn comprises two or more different monofilament fill yarns having different cross-sectional shapes.

27. The woven silt fence fabric of claim 1, wherein the woven silt fence fabric includes a lower grade line and an upper edge defining an installed height between the lower grade line and the upper edge.

28. The woven silt fence fabric of claim 1, wherein the one or more marker yarns comprise multiple groups of marker yarns having different color(s) than adjacent yarn(s) such the woven silt fence fabric includes two or more a grade line, an install line, a monitor line, and/or a high visibility line, and wherein:

each group of marker yarns has a same width as the other groups of marker yarns; or at least one group of marker yarns has a different width than at least one other group of marker yarns.

29. The woven silt fence fabric of claim 1, wherein the one or more of the grade line, install line, monitor line, and/or high visibility line identified by the one or more marker yarns comprise:

a singular end(s) of the one or more marker yarns; or a wider group of multiple ends of the one or more marker yarns.

* * * * *